United States Patent [19]

Audesse et al.

[11] 4,038,020

[45] July 26, 1977

[54] PHOTOFLASH LAMP

[75] Inventors: Emery G. Audesse; Donald E. Armstrong, both of Williamsport, Pa.

[73] Assignee: GTE Sylvania Incorporated, Montoursville, Pa.

[21] Appl. No.: 622,275

[22] Filed: Oct. 10, 1975

[51] Int. Cl.[2] ..... F21K 5/02

[52] U.S. Cl. ..... 431/93

[58] Field of Search ..... 431/93, 94, 95 R

[56] References Cited

U.S. PATENT DOCUMENTS

| | | | |
|---|---|---|---|
| 3,506,385 | 4/1970 | Weber et al. | 431/95 |
| 3,535,063 | 10/1970 | Anderson et al. | 431/93 |
| 3,771,941 | 11/1973 | Audesse et al. | 431/93 |
| 3,832,124 | 8/1974 | Loughridge et al. | 431/93 |

*Primary Examiner*—Alan Cohan
*Assistant Examiner*—Gerald A. Michalsky
*Attorney, Agent, or Firm*—Edward J. Coleman

[57] ABSTRACT

A photoflash lamp having a borosilicate glass envelope with a relatively high coefficient of thermal expansion and a depending metal primer tube, or set of lead-in wires, sealed to the glass envelope. The envelope maintains or enhances strong containment characteristics while at the same time economically providing an improved glass-to-metal seal wherein the glass is in radial compression.

8 Claims, 4 Drawing Figures

PRIOR ART

PHOTOFLASH LAMP

BACKGROUND OF THE INVENTION

This invention relates to photoflash lamps and, more particularly, to flashlamps containing a combustible material which is ignited to produce actinic light.

A typical photoflash lamp comprises an hermetically sealed glass envelope containing a quantity of combustible metal, such as shredded zirconium or hafnium foil, and a combustion-supporting gas, such as oxygen, at a pressure well above one atmosphere. In lamps intended for battery operated flash systems, the envelope also includes an electrical ignition system comprising a tungsten filament supported on a pair of lead-in wires having a quantity of ignition paste on the inner ends thereof adjacent to the filament. This type of lamp is operated by the passage of an electrical current through the lead-in wires which incandesces the filament to ignite the ingition paste which in turn ignites the combustible metal in the envelope. In the case of percussive-type photoflash lamps, such as described in U.S. Pat. No. 3,535,063, a mechanical primer is sealed in one end of the lamp envelope. The primer may comprise a metal tube extending from the lamp envelope and a charge of fulminating material on an anvil wire supported in the tube. Operation of the percussive photoflash lamp is initiated by an impact onto the tube to cause deflagration of the fulminating material up through the tube to ignite the combustible metal disposed in the lamp envelope.

Typically, the flashlamp envelope is comprised of G-1 type soft glass having a coefficient of thermal expansion within the range of 85 to 95 $\times 10^{-7}$in./in./° C between 20° C and 300° C, and the metal from which the primer tube is formed or the lead-in wires are made has a similar coefficient of thermal expansion so as to provide a match seal.

During lamp flashing, the glass envelope is subject to severe thermal shock due to hot globules of metal oxide and/or molten metal impinging on the walls of the lamp. As a result, cracks and crazes occur in the glass and, at higher internal pressures, containment failure becomes possible. In order to reinforce the glass envelope and improve its containment capability, it has been common practice to apply a protective lacquer coating on the lamp envelope by means of a dip process. To build up the desired coating thickness, the glass envelope is generally dipped a number of times into a lacquer solution containing a solvent and a selected resin, typically cellulose acetate. After each dip, the lamp is dried to evaporate the solvent and leave the desired coating of cellulose acetate, or whatever other plastic resin is employed.

In the continuing effort to improve light output, higher performance flashlamps have been developed which contain higher combustible fill weights per unit of internal envelope volume, along with higher fill gas pressure. In addition, the combustible material may be one of the hotter burning types, such as hafnium. Such lamps, upon flashing, appear to subject the glass envelopes to more intense thermal shock effects, and thus require stronger containment vessels. One approach to this problem has been to employ a hard glassenvelope, such as the borosilicate glass envelope described in U.S. Pat. No. 3,506,385 of Weber et al, along with a protective dip coating of cellulose acetate. More specifically, the Weber patent describes an electrically ignitable lamp having in-leads of a metal alloy such as Rodar or Kovar secured by an internal expansion match seal in a borosilicate glass envelope having a coefficient of thermal expansion in the range of 40 to 50 $\times 10^{-7}$ in./in./° C. Type 7052 glass, having an expansion of about 47, is mentioned as typical. It is theorized that glass in this thermal expansion range provides a more beneficial mode of fracture which results in a delay in crack time after flashing to a point where containment is more readily assured due to the reduction in lamp pressure over than period. In the hypothesis set forth in column 4, lines 56–65 of the Weber patent, this thermal expansion range is treated as relatively critical. The coefficient of thermal expansion is to be high enough to cuase substantial amounts of shaling of the inner surface of the lamp envelope at points of molten droplet impingement, so as to relieve the thermal and mechanical stresses in the glass, but not so high as to cause excessive deleterious crack propagation penetrating through the lamp wall. The patent teaches a maximum expansion coefficient of about 50, with an example in column 3, line 40, indicating a figure of 51 for type 706×1 glass.

In attempting to use such a glass envelope in the above-described percussive lamp structure, however, we have encountered sealing problems leading us to conclude that the coefficient of thermal expansion of the commercially suitable metals for the primer tube are not sufficiently low enought to provide a good, consistently crack-free seal to the glass. More specifically, referring to the envelope primer assembly of FIG. 1, in the above-referenced prior art percussive flashlamp, the metal primer tube 10 is secured to the glass envelope 12 by means of an internal expansion match seal. When envelope 12 is formed of a glass of the type described in the Weber patent (having a mean coefficient of thermal expansion about in the range of 40 to 50 $\times 10^{-7}$ in./in./° C between 0° C and 300° C) and tube 10 is formed of a low thermal expansion metal alloy such as Kovar or Rodar (having a mean coefficient of thermal expansion of about 50 $\times 10^{-7}$ in./in./° C between 25° C and 300° C), there appears to be a mismatch between the mating materials at the set point of the glass, such that upon cooling, the Kovar contracts more than the glass. In this event, tube 10 continues to adhere to envelope 12, but the greater contraction of the metal places the adjacent glass area under tension, as illustrated by the arrows. This results in an unacceptably weak seal area, as the strength of the glass is reduced in tension. For example, upon examining test samples of percussive-flashlamps made with envelopes 12 of one of the preferred glass compositions of the Weber patent, namely type 7052 glass (expansion of 47), we have observed cracks in the glass at the edge of the primer tube flare 10.

U.S. Pat. No. 3,832,124, assigned to the present assignee, confronts a similar seal mismatch problem with respect to an even lower expansion glass composition by employing a special primer tube with a tubular rim which bears against the exterior surface of the glass envelope, whereby the glass envelope is placed under compression upon cooling from the sealing process. Under a compressive strain, glass is made considerably stronger; hence, even though the materials are mismatched, a strong seal results. A disadvantage of such a solution, however, is that a special, somewhat more complexly shaped primer tube is required, thereby imposing added cost.

Another approach to the problem is described in U.S. Pat. No. 3,771,941, wherein a graded seal is employed comprising a bead of intermediate expansion glass sealed between a lower expansion glass envelope and a higher expansion primer tube. More specifically, a doughnut-shaped preform (bead) of pressed and sintered glass powder, such as type 7050 glass having an expansion of 46, is sealed about a Kovar or Rodar primer tube (expansion of 50) of the standard type shown in FIG. 1; then the end of a tubular envelope of, say, type 7070 hard glass (expansion of 32) is sealed about the glass bead. The resulting graded seal, even though involving a thermal expansion differential between the bead and primer tube similar to that between the envelope 12 and tube 10 of the lamp described with respect to FIG. 1, appeared to avoid the creation of high stresses at the glass to metal interface and cracking of the seal. This is probably due to lower contraction differences between the sealed components and the greater amount of working required to provide a graded seal. Disadvantages of this approach, however, are the added manufacturing cost involved in the requirement of a preformed glass bead in addition to the glass envelope and the greater amount of processing required to provide a graded seal.

SUMMARY OF THE INVENTION

In view of the foregoing, it is an object of the present invention to provide a photoflash lamp having an improved containment vessel.

Another object is to provide an improved glass-to-metal seal for a flashlamp having a hard glass envelope.

A principal object of the invention is to provide a photoflash lamp having a borosilicate glass envelope with strong containment characteristics and an improved glass-to-metal seal which is more economically obtained.

These and other objects, advantages and features are attained, in accordance with the invention, by employing an envelope formed of a borosilicate glass having a mean coefficient of thermal expansion in the range of about 52 to 55 $\times 10^{-7}$in./in./° C between 0° C and 300° C; one example is Corning type 7073 glass having a nominal expansion coefficient of about 53.5. Even though this thermal expansion characteristic significantly exceeds the range of the Weber patent, we have discovered quite unexpectedly that borosilicate glass in this critical expansion range (52 to 55) continues to substantially maintain or enhance the strong containment characteristics of the photoflash lamp envelope while at the same time economically providing an improved glass-to-metal seal. More specifically, upon using standard primer tube or lead-in wire ignition structures formed of a low expansion metal such as Kovar or Rodar, and routine sealing procedures, we have found this relatively high expansion borosilicate glass to be in a state of radial compression about the primer tube or lead-in wires after the seal is made — a condition wherein the glass at the seal area is rendered stronger and overall containment is enhanced. Of particular significance, we are able to successfully make strong, crack-free seals between the borosilicate glass envelope and primer tube of a percussive photoflash lamp without resorting to special structures or processes.

The surprisingly improved glass-to-metal seal achieved in accordance with the invention can be explained by considering the thermal properties of the joined materials at the set point of the glass. It is the respective coefficients of thermal expansion of the metal and glass at the set point of the glass that are the important factors in determining the final stress configuration of the seal. For example, FIG. 4 shows a schematic of the thermal expansion characteristics for Kovar or Rodar (curve B), Corning type 7073 glass (curve A) and Corning type 7052 glass (curve C). The strain point of 7073 glass is given as about 460° C; hence, the set point may be taken as about 465° C (see Handbook of Materials and Techniques for Vacuum Devices, by Walter H. Kohl, Reinhold Publishing Corp., New York, 1967, page 365). This set point for the 7073 glass is illustrated by the dashed vertical ine in FIG. 4. G indicates the contraction of the 7073 glass as it cools from its set point temperature of 465° C to room temperature, and M indicates the contraction of the Kovar over a corresponding range of cooling. The final stress effects in the glass are due to the amount and direction of the difference D in respective contractions. More specifically, as it is clear from FIG. 4 that 7073 glass (curve A) contracts more than the Kovar or Rodar (curve B) because of the significantly higher thermal expansion coefficient of this glass over Kovar or Rodar at the set point, the 7073 glass is placed in a state of compression at the seal. In contrast, the Kovar or Rodar contracts more than the prior art 7052 glass (curve C), which has a set point of about 440°, C, because of the significantly higher thermal expansion coefficient of the Kovar or Rodar over the 7052 glass at the 440° C set point. Accordingly, the 7052 glass is placed in a state of tension at the seal.

The coefficient of thermal expansion of glass at its set point, or at any point in the temperature range over 300° C, is very difficult to measure. Hence, the expansion characteristic typically published for a given glass is the mean coefficient between 0°and 300° C. Beyond this range, the characteristic is essentially extrapolated. In accordance with the present invention, we have determined that borosilicate glasses having a means coefficient of thermal expansion in the range of about 52 to 55 $\times 10^{-7}$ in./in./° C between 0° and 300° C appear to have a thermal expansion coefficient at the set point which is significantly higher than that of a low expansion metal such as Kovar or Rodar, whereupon a seal therebetween results in the glass being in a state of radial compression. As a result, stronger, more reliable photoflash lamps can be provided with a significant reduction in manufacturing shrinkage.

An additional manufacturing cost advantage of the higher expansion borosilicate glass of the invention is that is permits conventional scratch and shock cutting techiques to be used for obtaining linear tubing segments, whereas lower expansion borosilicate glasses of the type described in the aforementioned Weber patent have typically required the higher cost, more involved process of scoring, breaking and flame-polishing.

BRIEF DESCRIPTION OF THE DRAWINGS

This invention will be more fully described hereinafter in conjunction with the accompanying drawings, in which.

DESCRIPTION OF PREFERRED EMBODIMENT

The teachings of the present invention are applicable to either percussive or electrically ignited photoflash lamps of a wide variety of sizes and shapes. Accordingly, FIGS. 2 and 3 respectively illustrate percussive-type and electrically ignited photoflash lamps embodying the principles of the invention.

Figure 1:
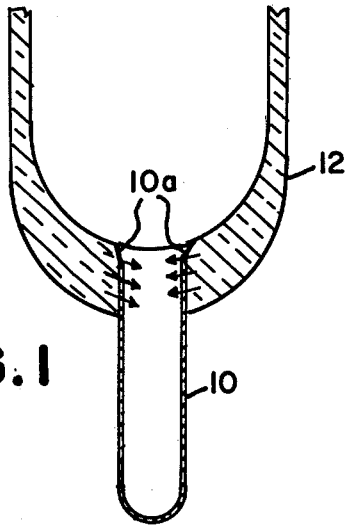
FIG. 1 is an enlarged fragmentary cross-section illustrating the glass-to-metal seal of a percussive flashlamp to which previous reference has been made.
Figure 2:
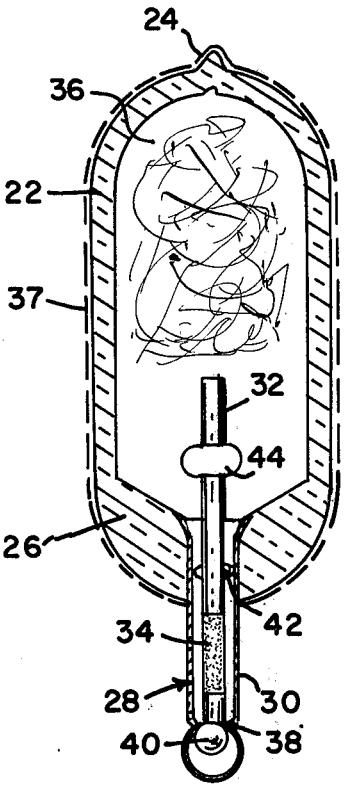
FIG. 2 is an enlarged sectional elevation of a percussive-type photoflash lamp having an envelope of a borosilicate glass in accordance with the invention.

The percussive-photoflash lamp illustrated in FIG. 2 comprises a length of light-transmitting tubing defining an hermetically sealed lamp envelope 22 constricted at one end to define an exhaust tip 24 and shaped to define a seal 26 about a primer 28 at the other end thereof. In accordance with the invention, envelope 22 comprises a borosilicate glass having a mean coefficient of thermal expansion in the range of about 52 to 55 $\times 10^{-7}$in./in./° C between 0° C and 300° C. The primer 28 comprises a metal tube 30, a wire anvil 32, and a charge of fulminating material 34. A combustible metal 36, such as filamentary zirconium or hafnium, and a combustion-supporting gas, such as oxygen, are disposed within the lamp envelope with the fill gas typically being at a pressure of greater than about 500 cm. Hg. and the quantity of combustible metal fill being at least about 18 mgs. The exterior surface of the glass envelope is covered with a protective coating 37 (denoted by dashed lines), such as cellulose acetate lacquer or a vacuum-formed thermoplastic coating, such as described in U.S. Pat. No. 3,770,366. The metal primer tube 30 has a means coefficient of thermal expansion of about 50 $\times 10^{-7}$ in./in./° C between 25° C and 300° C.

The wire anvil 32 is centered within the tube 30 and is held in place by a circumferential indenture 38 of the tube 30 which loops over the head 40, or other suitable protuberance, at the lower extremity of the wire anvil. Additional means, such as lobes 42 on wire anvil 32 for example, may also be used in stabilizing the wire anvil, supporting it substantially coaxial within the primer tube 30 and insuring clearance between the fulminating material 34 and the inside wall of tube 30. A refractory or metal bead 44 is located on the wire anvil 32 just above the inner mouth of the primer tube 30 to eliminate tube 30 burn-through and function as a deflector to deflect and control the ejection of hot gases from the fulminating material in the primer. Typically, the lamp 22 has an internal diameter of less than one-half inch, and an internal volume of less than 1 cc., although the present invention is equally suitable for application to larger lamp sizes.

Figure 3:
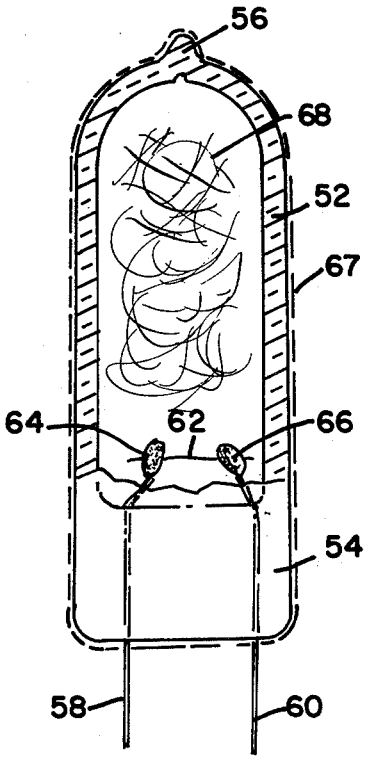
FIG. 3 is an enlarged elevationed view, partly in section, of an electrically ignitable photoflash lamp having an envelope of a borosilicate glass in accordance with the invention.
Figure 4:
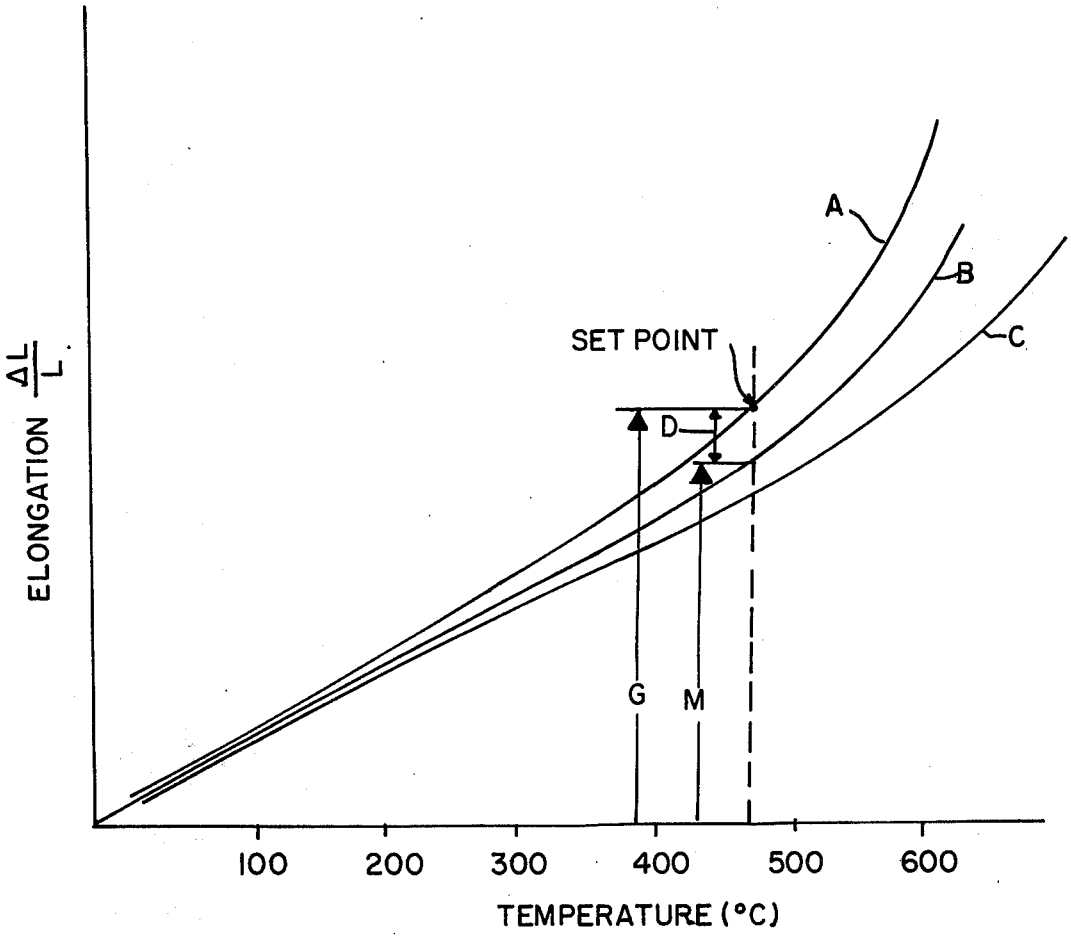
FIG. 4 is a previously referred to schematic of the thermal expansion characteristics for a metal alloy known as Kovar or Rodar (curve B), Corning type 7073 glass (curve A) and Corning type 7052 glass (curve C), with contraction differences at the set point of 7073 glass indicated thereon.

Referring to FIG. 3 an electrically ignitable lamp is shown comprising an hermetically sealed, light-transmitting lamp envelope 52 having a press 54 defining one end thereof and an exhaust tip 56 defining the other end thereof. Again, in accordance with the invention, envelope 52 comprises a borosilicate glass having a means coefficient of thermal expansion in the range of about 52 to 55 $\times 10^{-7}$ in./in./° C between 0° C and 300° C. Supported by the press 54 in an ignition means comprising a pair of lead-in wires 58 and 60 extending through and sealed into the press. The lead-in wires 58 and 60 have a mean coefficient of thermal expansion of about 50 $\times 10^{-7}$ in./in./° C between 25° C and 300° C. A filament 62 spans the inner ends of the lead-in wires, and beads of primer 64 and 66 are located on the inner ends of the lead-in wires 58 and 60 respectively at their junctions with the filament. The lamp of FIG. 3 is also typically a subminiature type having envelope dimensions similar to those described with respect to FIG. 2. The exterior surface of the glass envelope is covered with a protective coating 67 (denoted by dashed lines), such as cellulose acetate lacquer or a vacuum-formed thermoplastic coating. A combustion-supporting gas, such as oxygen, and a filamentary combustible metal 68, such as shredded zirconium or hafnium foil, are disposed within the lamp envelope. Typically, the combustion-supporting gas fill is a pressure exceeding about 500 centimeters of mercury, and the lamp is loaded with at least about 18 milligrams of the filamentary combustible metal.

Although the lamp of FIG. 3 electrically ignited, usually from a battery source, and the lamp of FIG. 2 is percussion-ignitable, the lamps are similar in that in each the ignition means is attached to one end of the lamp envelope and disposed in operative relationship with respect to the filamentary combustible metal 36 or 68. More specifically, the igniter filament 62 of the flash lamp in FIG. 3 in incandesced electrically by current passing through the metal filament support leads 58 and 60, whereupon the incandescent filament 62 ignites the beads of primer 64 and 66 which in turn ignite the combustible metal 68 disposed within the lamp envelope. Operation of the percussive-type lamp of FIG. 2 is initiated by an impact onto tube 30 to cause deflagration of the fulminating material 34 up through the tube 30 to ignite the combustible metal 36 disposed within the lamp envelope. The invention is also applicable to other types of electrically ignited lamps, such as those having spark gap or primer bridge ignition structures.

Primer tube 30 (FIG. 2) and lead-in wires 58 and 60 (FIG. 3) preferably are formed of a metal alloy of iron nickel and cobalt, such as that commerically known as Kovar, Rodar, etc. This alloy has composition which is approximately 54% Fe, 29% Ni, 17% Co, <0.5 Mn, <0.2% Si, and <0.06% C and a mean coefficient of thermal expansion of about 50 $\times 10^{-7}$ in./in./° C between 25° C and 300° C.

In practicing the invention, it is comtemplated that a number of borosilicate glass compositions having the aforementioned 52 and 55 expansion range may be suitable for forming the photoflash lamp envelopes discussed above. For example, such a glass composition can consist essentially of the following constituents in about the ranges stated by weight: 59 to 70% $SiO_2$,9 to 24% $B_2O_3$, 1 to 12% $Al_2O_3$, 4 to 9% total alkali oxides, and 0 to 3% BaO, except for incidental impurities and residual fluxes and refining agents.

In one specific embodiment of the invention, a percussive flashlamp of the type shown in FIG. 2 was provided with an envelope 22 formed from tubing of a borosilicate glass known commercially as Kimble type EN-7 glass, which has a mean coefficient of thermal expansion of about 53.5 $\times 10^{-7}$in./in./° C between 0° C and 300° C, and a glass composition, by weight, of approximately: 65.7% $SiO_2$, 8.85% $Al_2O_3$, 16.6% $B_2O_3$, 0.89% $Li_2O$, 6.9% $Na_2O$, 0.75% $K_2O$, 0.26% Cl, and 0.05% $Fe_2O_3$. The lamp contained a combustible fill comprising about 18 mgs. of shredded zirconium foil and oxygen at a fill pressure of about 13.8 atmospheres. The tubular envelope 22 had a nominal outside diameter of 0.259 inch, a wall thickness of about 0.030 inch, an overall outside length of about 0.980 inch, and an internal volume of about 0.35 cc. The outside surface of the envelope was coated with about four layers of cellulose acetate 37, to provide an overall outside diameter of about 0.280 inch. The primer tube 30 was formed of Rodar and had a nominal outside diameter of about 0.060 inch, a wall thickness of 0.003 inch, and a slight flare at the open end (0.080 inch outside diameter). Lamps made in this manner exhibited a good glass-to-metal seal, with no cracks being observed; the lamps also exhibited strong containment characteristics.

According to another specific embodiment of the invention, an electrical flashlamp of the type shown in FIG. 3 was provided with an envelope 52 formed of the EN-7 borosilicate glass tubing. This lamp contained a combustible fill comprising about 25 mgs. of shredded hafnium foil and oxygen at a fill pressure of about 12.8 atmospheres. The tubular envelope 52 had a nominal outside diameter of 0.259 inch, a wall thickness of about 0.030 inch, an overall outside length of about 0.980 inch, and an internal volume of about 0.35 cc. The outside surface of the envelope was coated with about four layers of cellulose acetate 67, to provide an overall outside diameter of about 0.280 inch. The inleads 58 and 60 were formed of Rodar wire having a diameter of about 14 mils and extended through the conventional press seal 54 to the inside of the lamp for supporting the tungsten filament 62 and primer beads 64 and 66.

Comparative stress readings were made in seal area sections taken from annealed glass bulbs for lamp envelopes 52 which had been sealed to Rodar lead-in wires 58 and 60. In one sample quantity the bulbs were formed of EN-7 glass in accordance with the invention, while the other sample quantity comprised prior art bulbs formed of 7052 glass. The average radial stress measured in the EN-7 glass was about 416 psi, compressive, whereas the average radial stress in the 7052 glass was 631 psi, tension. This clearly indicates the improved seal characteristics obtained with the EN-7 glass and Rodar lead-in wire combination, in accordance with the invention, as glass is much stronger in compression. Lamps of this type also exhibited strong containment characteristics.

In a further embodiment of this invention, an electrical flashlamp of the type shown in FIG. 3 was provided with an envelope 52 formed from tubing of a borosilicate glass known commercially as Corning type 7073 glass, which has a mean coefficient of thermal expansion of about $53.5 \times 10^{-7}$ in./in./° C between 0° C and 300° C and a glass composition, by weight of approximately: 63.4% $SiO_2$, 7.2% $Al_2O_3$, 17.8% $B_2O_3$, 0.6% $Li_2O$, 3.9% $Na_2O$, 4.6% $K_2O$, 2.2% BaO, and 0.2% Cl. The remaining parameters of the lamp envelope, lead-in wires and lamp fill were the same as those given above for the electrical lamp with a type EN-7 glass envelope.

Comparative stress readings were made in seal area sections taken from annealed glass bulbs for lamp envelopes 52 which had been sealed to Rodar lead-in wires 58 and 60. In one sample quantity the bulbs were formed of 7073 glass in accordance with the invention, while the other sample quantity comprised prior art bulbs formed of 7052 glass. The average radial stress measured on the 7073 glass was about 310 psi, compressive, whereas the average radial stress in the 7052 glass was 494 psi, tension. In like manner to the EN-7 glass, this indicates the improved seal characteristics obtained with a combination of 7073 glass and Rodar lead-in wires, in accordance with the invention, in view of the compressive stress mode of the glass. Further, the 7073 glass lamps of this type actually exhibited improved containment characteristics as compared to similar type lamps with 7052 glass envelopes.

Although the invention has been described with respect to specific embodiments, it will be appreciated that modifications and changes may be made by those skilled in the art without departing from the true spirit and scope of the invention.

What we claim is:

1. A photoflash lamp comprising:

an hermetically sealed, light-transmitting envelope;

a quantity of combustible material located in said envelope;

a combustion-supporting gas in said envelope; and ignition means attached to said envelope and disposed in operative relationship to said combustible material;

said ignition means including at least one metallic member passing through and sealed in one end of said envelope; and said envelope comprising a borosilicate glass having a mean coefficient of thermal expansion in the range of about 52 to $55 \times 10^{-7}$ in./in./° C between 0° C and 300° C and a coefficient of thermal expansion at the set point thereof which is higher than the coefficient of thermal expansion of said metallic member at the setpoint of said glass, whereby the glass about the seal to said metallic member is in a state of radial compression.

2. The lamp of claim 1 wherein the internal volume of said envelope is less than about 1 cubic centimeter, said combustible material is filamentary, the weight of said quantity of filamentary material is at least about 18 milligrams, and the fill pressure of said combustion-supporting gas is greater than about 900 centimeters of mercury.

3. The lamp of claim 1 wherein said metallic member has a mean coefficient of thermal expansion of about $50 \times 10^{-7}$ in./in./° C between 25° C and 300° C.

4. The lamp of claim 3 wherein said lamp is a percussive type, and said ignition means comprises a primer secured to and extending from one end of said envelope and in communication therewith, said primer including a metal tube sealed in said end of said envelope and having an exposed segment outside said envelope, and a body of fulminating material located in the exposed segment of said tube, said metal tube being said metallic member.

5. The lamp of claim 3 wherein said ignition means includes a pair of lead-in wires sealed through one end of said envelope and extending inside said envelope, and a filament disposed within said envelope and attached to said lead-in wires, said lead-in wires being said metallic member.

6. The lamp of claim 1 wherein the borosilicate glass of said envelope has a composition consisting essentially of the following constituents in about the ranges stated by weight: 59 to 70% $SiO_2$, 9 to 24% $B_2O_3$, 1 to 12% $Al_2O_3$, 4 to 9% total alkali oxides, and 0 to 3% BaO, except for incidental impurities and residual fluxes and refining agents.

7. The lamp of claim 6 wherein said metallic member is composed of an alloy comprising iron, nickel and cobalt and having a mean coefficient of thermal expansion of about $50 \times 10^{-7}$ in./in./° C between 25° C and 300° C.

8. The lamp of claim 1 wherein the borosilicate glass of said envelope has a composition consisting essentially of the following constituents in about the ranges stated by weight: 63 to 66% $SiO_2$, 16.5 to 18.0% $B_2O_3$, 7 to 9% $Al_2O_3$, 8.0 to 8.6% total alkali oxides, and 0 to 3% BaO, except for incidental impurities and residual fluxes and refining agents, and having a mean coefficient of thermal expansion of about $53.5 \times 10^{-7}$ in./in./° C between 0° C and 300° C.

* * * * *